US005507922A

United States Patent [19]

Hermeling et al.

[11] Patent Number: 5,507,922

[45] Date of Patent: Apr. 16, 1996

[54] PREPARATION OF BENZALDEHYDE DIALKYL ACETALS

[75] Inventors: Dieter Hermeling, Frankenthal; Heinz Hannebaum, Ludwigshafen; Hartwig Voss, Frankenthal; Andreas Weiper-Idelmann, Mannheim, all of Germany

[73] Assignee: BASF Aktiengesellschaft, Ludwigshafen, Germany

[21] Appl. No.: 289,277

[22] Filed: Aug. 11, 1994

[30] Foreign Application Priority Data

Aug. 14, 1993 [DE] Germany ..... 43 27 361.0

[51] Int. Cl.[6] ..... C25B 3/02

[52] U.S. Cl. ..... 205/456

[58] Field of Search ..... 204/59 R, 72, 204/78

[56] References Cited

U.S. PATENT DOCUMENTS

| | | | |
|---|---|---|---|
| 4,318,783 | 3/1982 | Buhmann et al. | 204/59 R |
| 5,208,384 | 5/1993 | Hermeling | 568/426 |
| 5,326,438 | 7/1994 | Hermeling | 204/78 |

FOREIGN PATENT DOCUMENTS

| | | |
|---|---|---|
| 12240 | 6/1980 | European Pat. Off. . |
| 4106661 | 9/1992 | Germany . |

*Primary Examiner*—John Niebling
*Assistant Examiner*—Edna Wong
*Attorney, Agent, or Firm*—Keil & Weinkauf

[57] ABSTRACT

Benzaldehyde dialkyl acetals of the general formula I

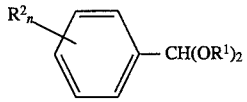

I where $R^1$ is $C_1$–$C_6$-alkyl, $R^2$ is $C_1$–$C_6$-alkyl, $C_1$–$C_6$-alkoxy, halogen, cyano or carboxyalkyl where the alkyl group is of 1 to 6 carbon atoms, n is an integer of from 1 to 3 and the radicals $R^2$ may be identical or different when n is >1, are prepared by electrochemical oxidation of a substituted toluene compound of the general formula II

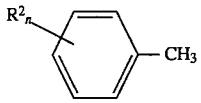

II by a process in which a substituted toluene compound II is oxidized in the presence of an alkanol $R^1$—OH and of an auxiliary electrolyte in an electrolysis cell, the reaction solution thus obtained is let down outside the electrolysis cell to a pressure which is from 10 mbar to 10 bar lower than the pressure in the electrolysis cell and A) in the batchwise procedure, the gas released from the reaction solution on letting down the latter is separated off and the reaction solution is recycled at least once to the electrolysis cell, subjected to electrolysis, let down, separated from the released gas and then worked up to obtain the product, or B) in the continuous procedure, some of the reaction solution is worked up to obtain the product and the remaining part of the reaction solution is mixed with an amount of the originally used reaction solution which corresponds to the part removed and is recycled to the electrolysis cell, subjected to electrolysis and let down.

9 Claims, No Drawings

PREPARATION OF BENZALDEHYDE DIALKYL ACETALS

The present invention relates to an improved process for the preparation of benzaldehyde dialkyl acetals of the general formula I

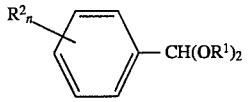

I where $R^1$ is $C_1$–$C_6$-alkyl, $R^2$ is $C_1$–$C_6$-alkyl, $C_1$–$C_6$-alkoxy, halogen, cyano or carboxyalkyl where the alkyl group is of 1 to 6 carbon atoms, n is an integer of from 1 to 3 and the radicals $R^2$ may be identical or different when n is >1, by electrochemical oxidation of a substituted toluene compound of the general formula II

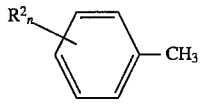

II

The products I are used as intermediates for the preparation of crop protection agents and drugs.

DE-A 41 06 661 relates to a process for the preparation of substituted 2-methylbenzaldehyde dialkyl acetals. According to this publication, the process can be carried out continuously or batchwise at atmospheric or superatmospheric pressure. However, the selectivities to be achieved according to this publication are not sufficient in all cases for carrying out the process on a large industrial scale.

EP-12 240 relates to the electrochemical oxidation of unsubstituted or substituted toluene compounds to the corresponding benzaldehyde dialkyl acetals in the presence of alkanols and of conductive salts which are derived from sulfuric acid or phosphoric acid. In a continuous embodiment of the process, the reaction mixture can be worked up by distillation to give the product, and the byproducts isolated are recycled to the oxidation stage. Byproducts which may interfere with the oxidation reaction are subjected to hydrogenation before being recycled. The Examples reveal that the batchwise electrochemical oxidation of p-tert-butyltoluene leads to p-tert-butylbenzaldehyde dialkyl acetal with a selectivity of 63%, or up to 92% when the byproducts are treated by hydrogenation, at a conversion of 26%. However, the conversion thus obtained is unsatisfactory since large amounts of the unconverted starting material are either discarded or must be recycled. The statement in this publication to the effect that the current density should be reduced and hence the selectivity of the reaction increased results in a reduction in the space-time yield of the process and therefore reduces its cost-efficiency.

It is an object of the present invention to provide a process which permits the continuous electrochemical preparation of benzaldehyde dialkyl acetals both with high conversions and with high selectivities.

We have found that this object is achieved by the process defined above, wherein a substituted toluene compound II is oxidized in the presence of an alkanol $R^1$—OH and of an auxiliary electrolyte in an electrolysis cell, the reaction solution thus obtained is let down outside the electrolysis cell to a pressure which is from 10 mbar to 10 bar lower than the pressure in the electrolysis cell and A) in the batchwise procedure, the gas released from the reaction solution on letting down the latter is separated off and the reaction solution is recycled at least once to the electrolysis cell, subjected to electrolysis, let down, separated from the released gas and then worked up to obtain the product, or B) in the continuous procedure, some of the reaction solution is worked up to obtain the product and the remaining part of the reaction solution is mixed with an amount of the originally used reaction solution which corresponds to the part removed and is recycled to the electrolysis cell, subjected to electrolysis and let down.

The novel process may be illustrated as follows:

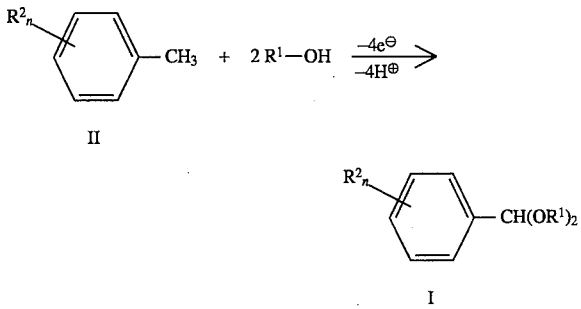

The starting compounds II are known or can be obtained by known methods. Specifically, the variables have the following meanings:

$R^1$ is $C_1$–$C_6$-alkyl, preferably $C_1C_4$-alkyl, especially methyl or ethyl;

$R^2$ is $C_1$–$C_6$-alkyl, such as methyl, ethyl, n-propyl, isopropyl, n-butyl, tert-butyl, tert-amyl or n-hexyl, preferably methyl, ethyl, isopropyl or tert-butyl;

$C_1$–$C_4$-alkoxy, such as methoxy, ethoxy, n-propoxy or tert-butoxy, preferably methoxy, ethoxy or tert-butoxy;

halogen, such as fluorine, chlorine, bromine or iodine, preferably chlorine;

cyano;

carboxyalkyl, where the alkyl group is of I to 6 carbon atoms, such as carboxymethyl or carboxyethyl;

n is an integer of from 1 to 3, preferably 1.

In view of their use as intermediates for crop protection agents and drugs, preferred compounds II are those of the formula III in which $R^3$ is $C_1$–$C_6$-alkyl or $C_1$–$C_4$-alkoxy.

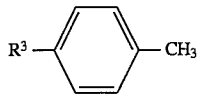

III

The preparation of the following compounds is particularly preferred:

4-methylbenzaldehyde dimethyl acetal
4-methylbenzaldehyde diethyl acetal
4 - ethylbenzaldehyde dimethyl acetal
4-isopropylbenzaldehyde dimethyl acetal
4-n-butylbenzaldehyde diethyl acetal
4-tert-butylbenzaldehyde dimethyl acetal
4-methoxybenzaldehyde dimethyl acetal
4-ethoxybenzaldehyde dimethyl acetal
4-tert-butoxybenzaldehyde dimethyl acetal The novel process can be carried out both batchwise and continuously. The common feature of both embodiments is that the electrochemical oxidation of the starting compound II is carried out in the electrolysis cell and the resulting reaction solution is let down to a pressure which is from 10 mbar to 10 bar lower than the pressure in the electrolysis cell. The pressure in the electrolysis cell is preferably from 0.1 to 6 bar above atmospheric pressure. This pressure can be established in the electrolysis cell preferably by means of a pump but may also be generated by an inert gas, such as nitrogen. The reaction solution is let down preferably to atmospheric pressure after the oxidation step.

A) Batchwise Embodiment

In a batchwise embodiment of the invention, gas released on letting down the reaction solution after the electrolysis is separated off, said gas being predominantly hydrogen discharged from the electrolysis cell. The reaction solution is then recycled to the electrolysis cell, subjected to electrolysis and then let down. This sequence of process steps is referred to below as cycles. It has proven advantageous to subject the reaction solution to a large number of cycles, with the result that, in an economical manner, a higher yield can be achieved than in only two cycles. From 20 to 1,000, particularly preferably from 100 to 800, cycles are preferred. The oxidation of the starting compound II in one cycle is not in general taken to complete conversion. Depending on the number of cycles, the conversion is in general from 0.1 to 5% of the theoretical conversion. Once the desired degree of oxidation of the starting compound II has been reached, the reaction solution is worked up to obtain the product. This is done in a conventional manner, predominantly by distillation. If a solvent is present in the reaction solution, it is distilled off. When neutral salts are used as an auxiliary electrolyte, they can be subsequently filtered off before the acetal I is distilled. The solvent, electrolyte and unconverted starting compound can be reused in further process batches.

B) Continuous Embodiment

The continuous embodiment of the present invention is preferred. After letting down the reaction solution, which, as described under A), is not in general electrolyzed to complete oxidation of the starting compound, a bleed stream of the reaction solution is separated off and worked up. This bleed stream is generally less than 5, preferably from 0.01 to 1, % by weight of the total stream. By means of this bleed stream, some of the gas dissolved in the reaction solution is discharged from the electrolysis circulation. Separate degassing of the total reaction solution is not necessary but may be advantageous in the case of small bleed streams and relatively large amounts of gas. The bleed stream is worked up as described above. The solvent, auxiliary electrolyte, starting compounds and any incompletely oxidized intermediates may be added to the reaction solution which is recycled to the electrolysis cell. The recycled reaction solution is furthermore replenished with the amount of starting compounds which corresponds to the amount of product separated off. After recycling and oxidation, the cycle described is repeated as often as required.

In all embodiments described, the reaction is carried out in the presence of an auxiliary electrolyte. This is present as a rule in a concentration of from 0.1 to 6% by weight, based on the reaction mixture. Protic acids, such as organic acids, e.g. methanesulfonic acid, benzenesulfonic acid or toluenesulfonic acid, as well as mineral acids, such as sulfuric acid and phosphoric acid, are suitable. Neutral salts may also be used as auxiliary electrolytes. Suitable cations are metal cations of lithium, sodium or potassium, as well as tetraalkylammonium compounds, such as tetramethylammonium, tetraethylammonium, tetrabutylammonium and dibutyldimethylammonium. Examples of anions are fluoride, tetrafluoborate, sulfonates, such as methanesulfonate, benzenesulfonate or toluenesulfonate, sulfates, such as sulfate, methylsulfate or ethylsulfate, phosphates, such as methylphosphate, ethylphosphate, dimethylphosphate, diphenylphosphate or hexafluorophosphate, and phosphonates, such as methyl methylphosphonate and methyl phenylphosphonate.

Alkanols used are preferably straight-chain $C_1$–C6alkanols; methanol and ethanol are particularly preferred. The concentration of the alkanol in the feed to the electrolysis cell is, as a rule, from 50 to 98, preferably from 70 to 95, % by weight.

The reaction mixture may contain one or more additional inert solvents. Compounds such as methylene chloride, acetonitrile, methyl tert-butyl ether, butyrolactone or dimethyl carbonate are suitable for this purpose. The concentration of these solvents may be from 0 to 30% by weight, based on the reaction mixture.

The current density in the novel process is, as a rule, from 2 to 10, preferably from 3 to 8, A/dm$^2$.

The total charge quantity transferred to the starting compound II in the novel process is in general from 3 to 9, preferably from 4 to 8, F/mol of II.

Suitable anode materials are noble metals, such as platinum, and oxides, such as chromium oxide or ruthenium oxide, as well as mixed oxides, such as Ti/RuO$_x$. However, graphite is the preferred anode material.

Suitable cathode materials are in general steel, iron, copper, zinc, nickel and carbon, as well as noble metals, such as platinums however, graphite is preferred.

The electrochemical oxidations can be carried out in divided flow-through cells but are preferably effected in undivided flow-through cells. The oxidation is carried out, as a rule, at from 0° to 120° C., preferably from 20° to 80° C.

The products I can be hydrolyzed in a conventional manner to give the corresponding aldehydes. The compounds I are thus storage-stable depot compounds for the substantially more sensitive aldehydes. The novel process permits the reaction of the starting compounds II to give the products I with high conversion. Remarkably, the electrochemical oxidations take place with high selectivity under these conditions. The byproducts which may be formed in the reaction can be recycled to the reaction without special working-up steps. No troublesome secondary reactions due to such byproducts were found.

EXAMPLES

Example 1

Electrosynthesis of P-tert-butylbenzaldehyde dimethyl acetal

All Examples were carried out in an undivided flow-through cell having graphite electrodes 1 mm apart, flow into the cell being from below. The reaction temperature was 55° C. The excess pressure in the reaction was generated by means of a pump. In the Examples according to the invention, the reaction solution was let down to atmospheric pressure after oxidation. The gases released were able to escape both in the batchwise and in the continuous procedure. The current density in all Examples was 3.4 A/dm$^2$ and the charge quantity was 7.5 F/mol of starting compound. The electrolyte was circulated at 200 l/h.

The electrolyte had the following composition:

450 g (15% by weight) of p-tert-butyltoluene 10 g (0.3% by weight) of sulfuric acid 2,450 g (84.7% by weight) of methanol For working up, the electrolyte was neutralized with sodium methylate, the methanol was distilled off and the precipitated salt was filtered off. Distillation under reduced pressure gave the stated products.

Example 1.1

According to the invention, batchwise

Excess pressure: 0.55 bar

Number of cycles: 700

The following were isolated (in mol %, based on p-tert-butyltoluene used):

1% of p-tert-butyltoluene

3% of p-tert-butylbenzyl methyl ether

78% of p-tert-butylbenzaldehyde dimethyl acetal

Example 1.2

According to the invention, continuous

Excess pressure: 0.55 bar

Worked-up bleed stream: 0.1% by weight of the total stream

Feed rate: 220 g of electrolyte/h

The following were isolated (in mol %, based on p-tert-butyltoluene used):

7% of p-tert-butyltoluene

9% of p-tert-butylbenzyl methyl ether

72% of p-tert-butylbenzaldehyde dimethyl acetal

Example 1.3

Comparison, batchwise

Carried out as for Example 1.1, but without excess pressure in the electrolysis cell The following were isolated (in mol %, based on the p-tert-butyltoluene used):

1% of p-tert-butyltoluene

18% of p-tert-butylbenzyl methyl ether

61% of p-tert-butylbenzaldehyde dimethyl acetal

Example 1.4

Comparison, continuous

Carried out as for Example 1.2, but without excess pressure in the electrolysis cell Worked-up bleed stream: 0.1% by weight of the total stream Feed rate: 220 g of electrolyte/h The following were isolated (in mol %, based on the p-tert-butyltoluene used):

11% of p-tert-butyltoluene

10% of p-tert-butylbenzyl methyl ether

60% of p-tert-butylbenzaldehyde dimethyl acetal

The table below shows the conversions and selectivities for Examples 1.1 to 1.4:

| Example | | | Conversion for TBT + TBE | Selectivity for acetal |
|---|---|---|---|---|
| 1.1 | inv. | batch. | 96% | 81% |
| 1.2 | inv. | cont. | 84% | 86% |
| 1.3 | comparison | batch. | 81% | 76% |
| 1.4 | comparison | cont. | 79% | 76% |

inv.=according to the invention batch.=batchwise cont.=continuous

TBT=p-tert-butyltoluene

TBE=p-tert-butylbenzyl methyl ether (intermediate which can be converted into the acetal)

These values show clearly that the novel embodiments are superior, with regard to both conversion and selectivity, to the Comparative Examples in which the reaction mixture obtained after the electrochemical oxidation was not let down to a pressure which is lower than that of the electrolysis cell.

Example 2

Electrosynthesis of p-tert-butylbenzaldehyde dimethyl acetal

An auxiliary electrolyte differing from that in Example 1 was used.

The electrolyte had the following composition:

450 g (15% by weight) of p-tert-butyltoluene 10 g (1% by weight) of sodium benzenesulfonate 2,510 g (84% by weight) of methanol The electrochemical oxidation was carried out in a cell as described in Example 1, at 55° C. The current density was 3.4 A/dm$^2$. The various charge quantities are shown in the table below. The procedure was similar to that of Example 1. For working up, the reaction solution was freed from methanol by distillation, the precipitated salt was filtered off and the acetal was purified by distillation. The electrolyte was circulated at 200 l/h.

Example 2.1

According to the invention, batchwise

Excess pressure: 0.55 bar

Number of cycles: 700

The following were isolated (in mol %, based on p-tert-butyltoluene used):

0.2% of p-tert-butyltoluene

2% of p-tert-butylbenzyl methyl ether

83% of p-tert-butylbenzaldehyde dimethyl acetal

Example 2.2

According to the invention, continuous

Worked-up bleed stream: 0.15% by weight of the total stream

Feed rate: 307 g of electrolyte/h

The following were isolated (in mol %, based on p-tert-butyltoluene used):

9% of p-tert-butyltoluene

12% of p-tert-butylbenzyl methyl ether

72% of p-tert-butylbenzaldehyde dimethyl acetal

Example 2.3

Comparison, batchwise

Carried out as for Example 2.1, but without excess pressure in the electrolysis cell The following were isolated (in mol %, based on p-tert-butyltoluene used):

1% of p-tert-butyltoluene

12% of p-tert-butylbenzyl methyl ether

64% of p-tert-butylbenzaldehyde dimethyl acetal

| Example | Charge quantity F/mol TBT | Conversion for TBT + TBE | Selectivity for acetal |
|---|---|---|---|
| 2.1 inv. | batch. 7.5 | 98 | 85 |
| 2.2 inv. | cont. 6.0 | 79 | 91 |
| 2.3 comparison | batch. 7.5 | 87 | 74 |

The Examples show that, in the batchwise procedure under otherwise identical conditions, both conversion and selectivity in the novel process are substantially higher than in the Comparative Example. Furthermore, the selectivity can be further increased at high conversion by the continuous procedure with a smaller transfer charge quantity.

Example 3

Electrosynthesis of p-tolylaldehyde dimethyl acetal (batchwise)

Apparatus: As in Example 1

Temperature: 70° C.

Current density: 3.4 A/dm$^2$

Charge quantity: 5.5 F/mol

Excess pressure: 0.55 bar

Number of cycles: 750

The electrolyte had the following composition:

450 g (15% by weight) of xylene 30 g (1% by weight) of potassium benzenesulfonate 2,540 g (84% by weight) of methanol After carrying out the procedure and working up similarly to Example 1.1, the following were isolated:

4% of p-methylbenzyl methyl ether

81% of p-tolylaldehyde dimethyl acetal

The conversion was 96%, based on the starting compound and p-methylbenzyl methyl ether, and the selectivity (for acetal) was 84%.

Example 4

Electrosynthesis of p-anisaldehyde dimethyl acetal (continuous, with recycling of isolated compounds)

Apparatus: As in Example 1

Temperature: 50° C.

Current density: 4.2 A/dm$^2$

Charge quantity: 4.5 F/mol

Excess pressure: 0.35 bar

The electrolyte had the following composition:

15% by weight of p-methoxytoluene 0.4% by weight of sodium benzenesulfonate 83.1% by weight of methanol 3.5% by weight of recycled stream The procedure and working up were as in Example 1.3.

The recycled stream contained the components which had boiling points lower than the boiling point of the product in the working up of the bleed stream by distillation.

The conversion was 78%, based on the starting compound and p-methoxybenzyl methyl ether, and the selectivity (for acetal) was 91%.

We claim:

1. A process for the preparation of a benzaldehyde dialkyl acetal of the formula I

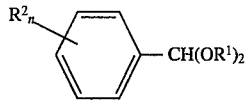

I where $R^1$ is $C_1$–$C_6$-alkyl, $R^2$ is $C_1$–$C_6$-alkyl, $C_1$–$C_6$-alkoxy, halogen, cyano or carboxyalkyl where the alkyl group is of 1 to 6 carbon atoms, n is an integer of from 1 to 3 and the radicals $R^2$ may be identical or different when n is >1, by electrochemical oxidation of a substituted toluene Compound of the formula II

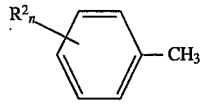

II which process comprises: oxidizing the substituted toluene in a reaction solution in the presence of an alkanol $R^1$—OH and an auxiliary electrolyte within an electrolysis cell, letting down the reaction solution outside the electrolysis cell to a pressure which is from 10 mbar to 10 bar lower than the pressure in the electrolysis cell and separating off gas released from the reaction solution on letting down the latter and recycling the reaction solution at least once to the electrolysis cell, wherein the solution is subjected to electrolysis and said let down, separated from the released gas and then worked up to obtain the benzaldehyde dialkyl acetal of the formula I.

2. A process as defined in claim 1, wherein a substituted toluene compound of the formula III

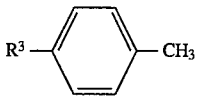

III where $R^3$ is $C_1$–$C_6$-alkyl or $C_1$–$C_4$-alkoxy, is electrochemically oxidized.

3. A process as defined in claim 1, wherein the reaction solution is let down to atmospheric pressure.

4. A process as defined in claim 1, wherein the reaction solution is let down to a pressure which is from 0.1 to 6 bar lower than the pressure in the electrolysis cell.

5. A process as defined in claim 2, wherein the reaction solution is let down to atmospheric pressure.

6. A process as defined in claim 2, wherein the reaction solution is let down to a pressure which is from 0.1 to 6 bar lower than the pressure in the electrolysis cell.

7. A process for the preparation of a benzaldehyde dialkyl acetal of the formula I

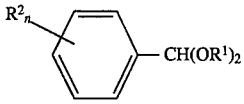

I where $R^1$ is $C_1$–$C_6$-alkyl, $R^2$ is $C_1$–$C_6$-alkyl, $C_1$–$C_6$-alkoxy, halogen, cyano or carboxyalkyl where the alkyl group is of 1 to 6 carbon atoms, n is an integer of from 1 to 3 and the radicals $R^2$ may be identical or different when n is >1, by electrochemical oxidation of a substituted toluene compound of the formula II

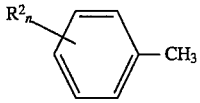

II which process comprises: oxidizing the substituted toluene compound II in a reaction solution in the presence of an alkanol $R^1$—OH and an auxiliary electrolyte within an electrolysis cell, letting down the reaction solution outside the electrolysis cell to a pressure which is from 10 mbar to 10 bar lower than the pressure in the electrolysis cell, working up a portion of the reaction solution to obtain the benzaldehyde dialkyl acetal of the formula I, a remaining part of the reaction solution being mixed with an amount of the reaction solution formed by oxidizing the compound II in the presence of the alkanol and auxiliary electrolyte which corresponds to a part worked up and recycling the reaction solution to the electrolysis cell where the solution is subjected to electrolysis and said let down.

8. A process as defined in claim 7, wherein the reaction solution is let down to atmospheric pressure.

9. A process as defined in claim 7, wherein the reaction solution is let down to a pressure which from 0.1 to 6 bar lower than the pressure in the electrolysis cell.

* * * * *